United States Patent [19]

Stadelhofer et al.

[11] 4,415,429

[45] Nov. 15, 1983

[54] PROCESS FOR THE PREPARATION OF HIGHLY AROMATIC PITCHLIKE HYDROCARBONS

[75] Inventors: Jürgen Stadelhofer, Dortmund; Heinz-Gerhard Franck, Bad Soden-Neuenhain; Helmut Köhler, Mülheim, all of Fed. Rep. of Germany

[73] Assignee: Rutgerswerke Aktiengesellschaft, Frankfurt am Main, Fed. Rep. of Germany

[21] Appl. No.: 171,203

[22] Filed: Jul. 22, 1980

[30] Foreign Application Priority Data

Aug. 30, 1979 [DE] Fed. Rep. of Germany ..... 2935039

[51] Int. Cl.[3] ..... C10G 1/06

[52] U.S. Cl. ..... 208/8 LE

[58] Field of Search ..... 208/8 LE, 14

[56] References Cited

U.S. PATENT DOCUMENTS

| | | | |
|---|---|---|---|
| 3,375,188 | 3/1968 | Bloomer | 208/8 LE |
| 3,642,608 | 2/1972 | Rooch et al. | 208/8 LE |
| 3,705,092 | 12/1972 | Gatsis | 208/8 LE |
| 3,966,585 | 6/1976 | Gray et al. | 208/8 LE |
| 4,021,329 | 5/1977 | Seitzer | 208/10 |
| 4,052,291 | 10/1977 | Esperscheid et al. | 208/8 LE |
| 4,052,292 | 10/1977 | Esperscheid et al. | 208/8 LE |
| 4,054,504 | 10/1977 | Chervenok et al. | 208/10 |
| 4,101,413 | 7/1978 | Jones et al. | 208/14 X |
| 4,111,786 | 9/1978 | Sugemura et al. | 208/8 LE |
| 4,170,543 | 10/1979 | Lipscomb et al. | 208/14 |
| 4,221,654 | 9/1980 | Stein et al. | 208/8 LE |
| 4,260,472 | 4/1981 | Eisenlohr et al. | 208/8 LE |

OTHER PUBLICATIONS

Hackh's Chemical Dictionary, 3rd Ed., QD5H3, 1944, C. 128, McGraw-Hill, pp. 61 & 663.

*Primary Examiner*—Delbert E. Gantz
*Assistant Examiner*—William G. Wright
*Attorney, Agent, or Firm*—Beveridge, DeGrandi and Kline

[57] ABSTRACT

A process for the production of a highly aromatic pitch-like hydrocarbon by disintegration of comminuted coal or similar carbonaceous raw material with hydrocarbon mixtures as solvent at elevated temperature and pressure.

7 Claims, No Drawings

PROCESS FOR THE PREPARATION OF HIGHLY AROMATIC PITCHLIKE HYDROCARBONS

The invention relates to a new process for the production of highly aromatic hydrocarbons, similar to coal tar pitch, by solubilization or disintegration of crushed coal or similar carbonaceous raw materials with hydrogen-transferable hydrocarbon mixtures as the solvent at elevated temperature and pressure.

BACKGROUND AND PRIOR ART

The dependence on imported mineral oil, the long-term shortage and the increase in price connected therewith of raw materials produced from mineral oil has initiated a world-wide search for hydrocarbon-containing raw materials. Since the supplies of coal clearly exceed the reserves of mineral oil, the concerned branches of industry and Government in countries with large coal deposits are striving to develop new feasible processes for refinement of coal to make these raw materials available. With that, it is possible to build on a broad base a knowledge, for the coal-chemical industry currently produces world-wide more than 20 million tons of coal refinement products. Quantitatively, the most important product of coal chemistry refining is coal tar pitch, the residue obtained from coal tar distillation. Coal tar pitch is used as a high grade raw material, especially for the production of electrodes and other types of artificial carbon, as a binder and structural building material. Other binders based on coal tar pitch are used, for example, in bituminous road construction, for the production of fire resistant stones and moulded coke for improvement of coking coal and for insulating materials for the building industry, wherein for these areas of application the ash content is of subordinate significance.

Because of the limited availability of coal tar pitch, attempts have been made to use other petroleum residues or residues of coal origin for the above mentioned fields of application. With regard to residues of petroleum origin, supply difficulties are to be expected in the future since, as explained previously, the petroleum reserves are shrinking drastically in the course of time. On the basis of coal, so-called "solvent refined coal products" (SRC-products) are proposed as pitch substitutes (cf. for example, Japan Kokai 78 88 001, C. A. 89, 217860c). These processes for the partial hydrogenation of coal provide for the use of molecular hydrogen in quantities of 2–4% and are correspondingly expensive; moreover, they do not lead to a highly aromatic product, since aliphatic portions also participate in the make-up of the coal which are not aromatized at the temperature customarily employed in coal hydrogenation.

A similar process is described for example, in the South African patent 74 03326 (C.A. 87, 8541u). As a solvent for the coal slurry preparation, heavy creosote oil or anthracene oil are mentioned. The mixture used is also subjected in that instance to the conditions of a hydrogenation with $H_2$. Beyond that, for example, Japan Kokai No. 78 96003 (C.A. 89,217864g) discloses a process for obtaining a "pitch" from coal by disintegration with a mixture of heavy oil, which is obtained by heat treatment of fuel oil at 350°–450° C., and tar acids, that is, phenols. The yield of disintegration coal, could be increased by the combination with the tar acids. These processes or the obtainable "pitch" have the following disadvantages:

Instead of the expensive molecular hydrogen, in this case likewise valuable chemical raw materials, namely phenols, are used for the disintegration of the coal. The same is true also for the use of anthracene oil and creosote oil. These oils generally must be recaptured by distillation and have strongly changed their chemical composition as a result of the transferring of hydrogen. Furthermore, the case of using molecular hydrogen, catalysts are needed as a rule, for example, iron or cobalt-molybdenum-oxide catalysts (see, U.S. Pat. No. 4,021,329; C.A. 87,258856).

SUMMARY OF THE INVENTION

The present invention is based on the task of making available a process and solvent mixture for the production of a highly aromatic hydrocarbon product, similar to the coal tar pitch, with partially improved characteristics as a monoproduct in one single processing step by disintegration of comminuted coal or similar carbonaceous raw materials with favorably priced hydrocarbon mixtures as solvents without the addition of molecular hydrogen or use of catalysts. With this invention, a process is made available for enlarging the raw material base of hydrocarbons.

DETAILED DESCRIPTION OF THE INVENTION

According to the invention, this task is solved by the process and solvent mixture defined herein. The inventive process is one in which comminuted coal or similar carbon containing material is mixed with a combination of aromatized petroleum derived solvents and highly aromatic coal-based solvents, and is homogenized in a reactor at elevated pressure and temperature. The type of coal utilized may be varied over wide ranges, however, hard coals with higher volatility content, such as bituminous coals containing more than 30% volatile matter are preferably used as the raw material. However, low-volatile hard coals, lignites, peat and C-containing waste materials, such as for example scrap tires may also be used for purposes of the invention. The degree of comminution is of subordinate importance in this process. In the selection of the types of coal to be used, merely an ash-content adapted to the end-use is of significance. According to the invention, residues from the steam pyrolysis of petroleum fractions which are obtained as coupling products in the production of olefins and are usually only used as fuel, may be employed as solvents of petroleum origin. These residues which boil in the area of 220° C. to above 450° C., (standard pressure) exhibit a high aromatic content (C/H ratio $>1$); they exhibit a distinct thermolability the consequence of which is on the one hand hydrogen liberation, and on the other hand an additional polymerization reaction and pitch formation. Both reactions, according to the invention are of advantage for the coal disintegration since the liberated hydrogen facilitates the coal degradation, i.e., it accelerates the breaking up of the aromatic clusters and the polymerization causes an additional homogenization. The reaction product of coal and pyrolysis oils alone, however, is extremely viscous and gummy, so that it cannot be called pitch and does not guarantee a further processing without problems.

In accordance with the invention, the adjustment of the flow properties takes place by complementary solvents. By complementary solvents is meant very high boiling mixtures of aromatics derived from coal, such as for example, pitch distillates from the hard pitch and electrode pitch production, re-distillates from pitch-coke-oils, coal-tar pitches as well as highest boiling tar fractions with middle boiling point >350° C. The boiling range preferably lies between 350° C. and 500° C. (Standard pressure). These solvents impart to the hydrocarbon of the invention pitch-like characteristics and moreover, a smooth break and high lustre. These highest boiling mixtures of aromatics boil higher than the anthracene oils customarily used for coal extraction, and they have excellent solvation characteristics for coal. For a further adjustment of the softening point and of other physico-chemical characteristics one may additionally use partly aromatized residues and/or high boiling oils obtained from catalytic cracking of petroleum fractions or the lower boiling mixtures of aromatics obtained from tar processing such as for example, solvent oils, anthracene oils, in a subordinate quantity.

According to the invention, the described reaction components in the constituent amounts of 10–50% comminuted coal, 10–50% pyrolysis residue from the steam cracking of petroleum fractions, 10–50% highest boiling mixtures of aromatics, possibly 10–30% of partly aromatized residues from cracking or distillation and 10–30% lower boiling tar aromatics, are brought into intimate contact, whereby a pumpable suspension which flows readily at >30° C. develops. This mixture is homogenized at temperatures in the range of 250°–420° C. and at elevated pressure up to 50 bar and for 1 to 5 hours, whereby the coal is converted into the quinoline soluble form for the part that is important for the pitch formation, and the oil components employed are homogenized. Selected components, reaction temperature, reaction pressure and dwell time are combined at the same time in such a way, that the treated coal is disintegrated to the extent of at least 50%. The physico-chemical characteristics of the pitch-like material, especially its softening point, the coking residue, viscosity, dense smoke behavior, penetration, Q I and T I may readily vary over wide ranges by coordination of the reaction components by way of their characteristics.

The pitch is obtained at a yield of more than 90%, based on the overall quantity of the substances used. With the process of the invention, only small quantities of water and of crack gas are obtained.

The product produced in this way may be easily granulated into a storable material. One advantage according to the invention also resides in the fact, that the formation of fine grains (formation of breeze) is reduced in comparison to hard coal pitch.

THE EXAMPLES

The subsequent examples will serve to illustrate the process of the invention. Examples 3 and 4 are comparative examples, which show that anthracene oils or pyrolysis residues from the steam pyrolysis of petroleum fractions alone, will not lead to the desired products.

EXAMPLE 1

The easily pumpable suspension, from the materials used, as listed in Table 1, is raised to the desired treatment temperature at a heating rate of 180° C./h, and with thorough mixing, is kept in a shaking autoclave for three hours at the desired reaction temperature, whereby the stated natural pressure builds up. After cooling down, the pressure of the vessel is released and the reaction water is separated. The reaction product may be removed easily from the reaction container by melting.

The broad possibility of variation of the product characteristics through selected reaction conditions, is apparent from the examples given in Table 2.

EXAMPLE 2

The procedure of example 1 is followed. As material used the components listed in Table 3 were employed. The detailed reaction conditions and the corresponding production characteristics are listed in Table 4.

TABLE 1

Products used for the production of a highly aromatic pitch-like hydrocarbon.

| | |
|---|---|
| 34 parts | of bituminous coal ("Westerholt") (water: 1.9%, volatile components, free of water and ash: 38%, ash free of water: 4.9%) |
| 12 parts | hard coal tar pitch (softening point [K.S.] 73° C.) |
| 11 parts | pitch distillate (boiling begins at: 335° C.; 40% to 455° C.) |
| 20 parts | pyrolysis residue from steam cracking of gas oil (boiling begins at: 230° C.; 50% up to 366° C.) |
| 12 parts | vacuum residue from catalytic cracking process (boiling begins at: 260° C.; 50% up to 435° C.) |
| 11 parts | pyrolysis pitch from the steam cracking of naphtha (softening point [K.S.] 88° C.) |

100 parts by weight of mixture used.

TABLE 2

Reaction Conditions and Product Characteristics in Example 1

| Reaction - temperature (°C.) | Max. reaction pressure (Bar) | Product Yield (%) | Elementary Composition (%) C | H | S | Product Characterization (a) E.P. | (b) QI (%) | (c) TI (%) | ash % | Coking residue acc. to Conradson (%) % |
|---|---|---|---|---|---|---|---|---|---|---|
| 340 | 16 | 97 | 88.58 | 5.72 | 1.46 | 121 | 10.8 | 35.9 | 1.5 | 39.9 |
| 375 | 27 | 97 | 89.15 | 5.30 | 1.50 | 109 | 14.8 | 41.2 | 1.6 | 46.2 |
| 400 | 44 | 96 | 89.40 | 5.02 | 1.48 | 102 | 27.4 | 47.8 | 1.7 | 53.9 |

(a) softening point (Kraemer-Sarnow) (°C.)
(b) quinoline-insoluble
(c) toluene-insoluble

TABLE 3

Feed stocks for the production of a highly aromatic, pitch-like hydrocarbon (Example 2).

| | |
|---|---|
| 30 parts | "Westerholt" - coal |
| 10 parts | coal tar pitch |
| 5 parts | pitch distillate |
| 35 parts | pyrolysis residue from the steam pyrolysis of gas oil |
| 20 parts | pitch distillate from the heat/pressure treatment of coal tar pitch (start of boiling: 275° C., 50% up to 416° C.) |

100 parts by weight of mixture used

TABLE 4

| Reaction - temperature (°C.) | Max. reaction pressure (Bar) | Product Yield (%) | Elementary Composition (%) C | H | S | Product Characterization (a) E.P. | (b) QI (%) | (c) TI (%) | ash % | Coking residue % |
|---|---|---|---|---|---|---|---|---|---|---|
| | Reaction Conditions and Product Characteristics According to Example 2 | | | | | | | | | |
| 340 | 10 | 97 | 87.88 | 5.50 | 2.20 | 117 | 10.4 | 37.2 | 1.5 | 38.3 |
| 375 | 18 | 97 | 88.20 | 5.38 | 2.20 | 107 | 13.4 | 38.7 | 1.6 | 42.5 |
| 400 | 34 | 97 | 88.88 | 5.00 | 1.91 | 105 | 24.9 | 44.8 | 1.9 | 51.5 |

(a) softening point (Kraemer-Sarnow) (°C.)
(b) quinoline-insoluble
(c) toluene-insoluble

EXAMPLE 3 (Comparative Example)

30 Parts of "Westerholt" coal are digested in 70 parts of anthracene oil (boiling begins at 300° C., 50% up to 350° C., 90% up to 385° C.) and after a heating up period of one hour it is kept for three hours at 375° C. 60% of the coal is converted into a quinoline soluble form.

The reaction product however, is not pitch-like at ambient temperature, but like honey, syrupy with partial crystalline areas.

EXAMPLE 4 (Comparative Example)

30 Parts of "Westerholt" coal are treated with 90 parts of pyrolysis oil from the naphtha steam pyrolysis (boiling begins at 200° C., 50% up to 217° C., 80% up to 355° C.) during three hours at 370° C. 65% of the coal is converted into quinoline soluble form.

The reaction product however, is not homogenous, and after a short time the separation of fine grains becomes noticeable as a bottom deposit.

We claim:

1. In a process for the production of a highly aromatic pitch-like hydrocarbon by disintegration of comminuted coal or similar carbon-containing raw materials with hydrocarbon mixtures as solvents with the use of elevated temperatures and pressure conditions, the improvement comprising decomposing said coal or other carbonaceous raw materials in an amount of 10–50% of the reaction components with 10–50% aromatized residues from steam cracking of petroleum fractions in combination with 10–50% of a complementary solvent with is an aromatic mixture originating from coal with middle boiling point above 350° C.

2. The process as in claim 1, wherein highest boiling aromatics from coal with a boiling range of 350° to 500° C. are used.

3. The process as in claims 1 or 2, wherein further solvents which are residues of catalytic cracking and distillation processes of mineral oil refining are mixed with the materials used.

4. The process as in claims 1 or 2 wherein aromatic tar oils boiling below 350° C. are added as further solvents.

5. The process as in claims 1 or 2 wherein 10–50% coal with a high volatile content in comminuted form, 10–50% of the petroleum derived solvent and 10–50% of the highly aromatized oils originating from coal, are mixed homogenously, and the liquid and pumpable suspension obtained is homogenized in the temperature range of 250°–420° C. under an elevated pressure up to 50 bar from 1 to 5 hours.

6. The process as in claim 5 wherein bituminous coal containing a volatile matter of more than 30% is employed.

7. The process as in claim 5 wherein 10–30% of additional solvents selected from residues of catalytic cracking and distillation processes of mineral oil refining, aromatic tar oils boiling below 350° C. and mixtures thereof are mixed with the materials used.

* * * * *